United States Patent [19]

Linde

[11] 4,149,222

[45] Apr. 10, 1979

[54] BED LIGHT SAFETY APPARATUS

[75] Inventor: Harry T. Linde, Fullerton, Calif.

[73] Assignee: Chemetron Corporation, Chicago, Ill.

[21] Appl. No.: 783,048

[22] Filed: Mar. 30, 1977

[51] Int. Cl.[2] ..... F21V 33/00; F21V 23/04

[52] U.S. Cl. ..... 362/130; 362/394; 362/801; 362/802

[58] Field of Search ..... 362/130, 95, 147, 155, 362/226, 368-371, 394, 427, 801, 802

[56] References Cited

U.S. PATENT DOCUMENTS

| | | | |
|---|---|---|---|
| 3,769,502 | 10/1973 | Schultz | 362/801 |
| 3,919,540 | 11/1975 | Burst | 362/130 |

*Primary Examiner*—Samuel W. Engle
*Assistant Examiner*—Donald P. Walsh
*Attorney, Agent, or Firm*—Vincent G. Gioia; John K. Williamson

[57] ABSTRACT

A bed light safety apparatus which includes a normally wall mounted lighting fixture. The upper rearward edge of the fixture is pivotally mounted to a plate adapted for attachment to a wall. One embodiment of the apparatus includes a switch carried by the fixture. When used in conjunction with a hospital bed or the like which is power operated to a raised position, the switch is made a part of the electrical circuit for the bed drive means. In the event equipment carried by the bed strikes the fixture on raising of the bed, the consequent pivotal movement of the fixture causes the switch to open the circuit to the bed drive means and halt further raising of the bed. In other embodiments the safety apparatus may include visual or auditory alarms actuable by a switch in the fixture.

3 Claims, 7 Drawing Figures

FIG. 1
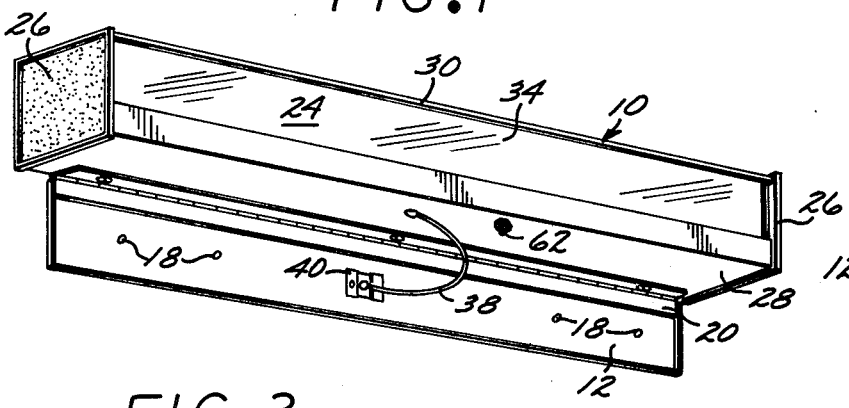
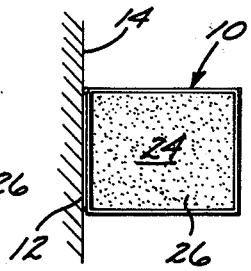
FIG. 2
FIG. 3
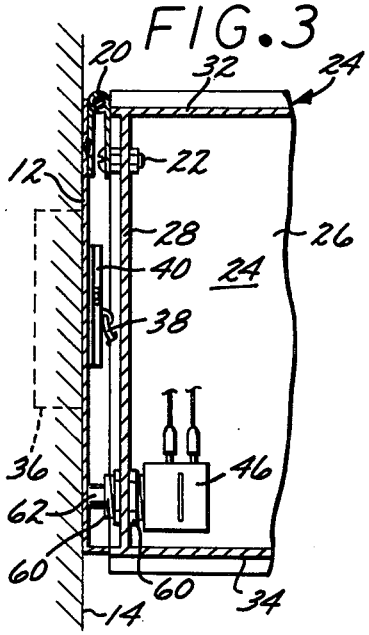
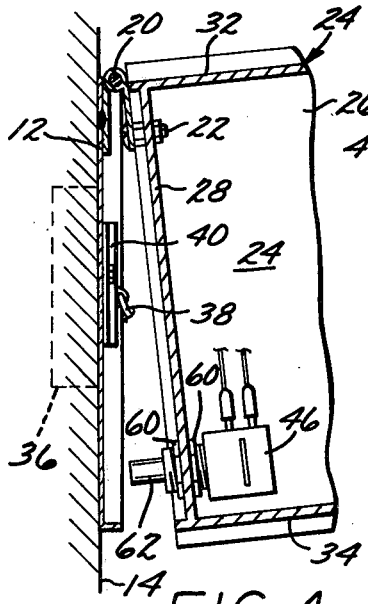
FIG. 4
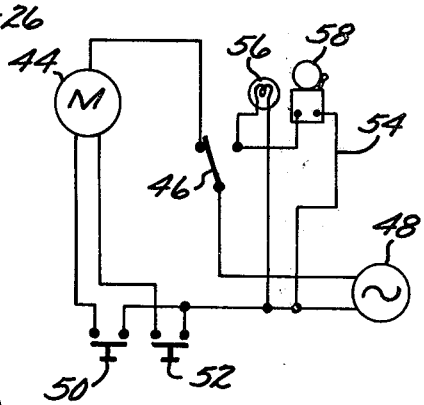
FIG. 7
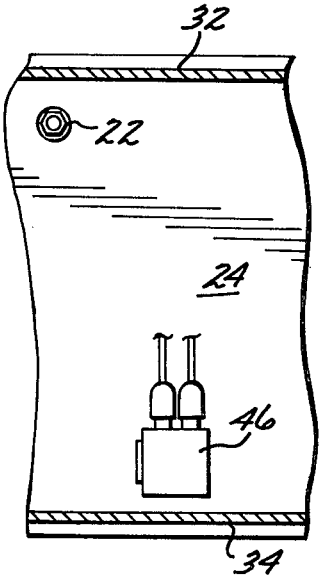
FIG. 5
FIG. 6
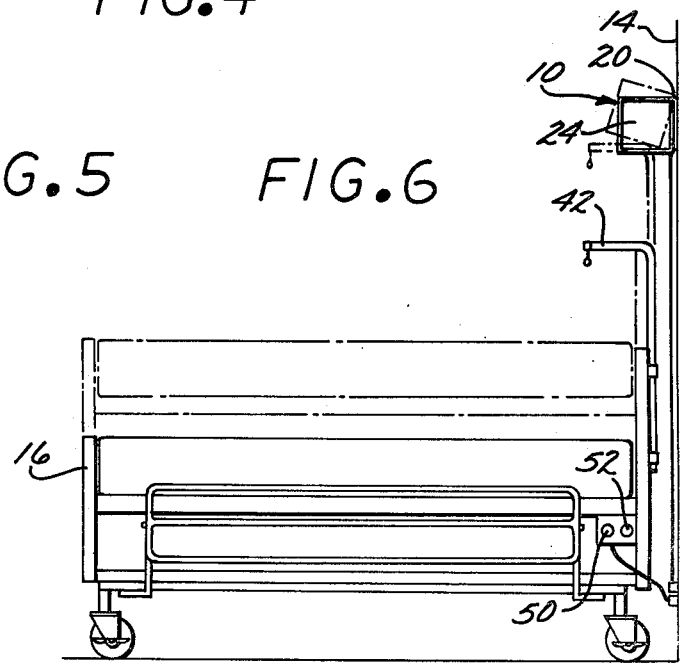

BED LIGHT SAFETY APPARATUS

BACKGROUND OF THE INVENTION

1. Field of the Invention

The invention relates to safety apparatus associated with a lighting fixture used in combination with a power operated bed.

2. Description of the Prior Art

Beds in hospitals, convalescent homes and the like are often power operated, the head or upper portion of the bed being raised by simply pressing a button to close an electrical circuit to a suitable drive means. Any equipment mounted to the bed, such as that used for intravenous feeding or for traction support of the patient, often accidentally strikes the lighting fixture which is normally over the bed on the wall behind the bed. This frequently damages the fixture or the equipment and invariably upsets the patient.

SUMMARY OF THE INVENTION

According to the present invention, a bed light safety apparatus is provided which includes a mounting plate for attachment to the wall behind the bed. An elongated lighting fixture is hinged at its upper rearward portion to the mounting plate so that it will pivot upwardly when accidentally struck by the bed or by equipment on the bed. A switch is coupled to the fixture and is operative upon upward pivotal movement of the fixture to change the operative state of an associated electrical circuit. This circuit may be arranged to include the drive means used for raising the bed, in which case operation of the switch opens the circuit to the drive means and prevents further raising of the bed. Alternatively, or in conjunction with such an arrangement, the circuit may also include an alarm, either visual, auditory, or both, which is operated by switch means carried by the lighting fixture or by the mounting plate. Thus, depending upon the particular embodiment, actuation of the switches immediately apprises the person raising the bed that the bed has just impacted against the lighting fixture, and such actuation can also be made to immediately open the circuit of the drive means to automatically stop raising of the bed.

Other objects and features of the invention will become apparent from consideration of the following description taken in connection with the accompanying drawings.

BRIEF DESCRIPTION OF THE DRAWINGS

FIG. 1 is a perspective view of a bed light safety apparatus, illustrating the lighting fixture in its upwardly pivoted position;

FIG. 2 is an end elevational view of the apparatus of FIG. 1, but illustrating the lighting fixture in its normal, downwardly pivoted position;

FIG. 3 is an enlarged transverse cross-sectional view of the apparatus, illustrating the switch in its closed position;

FIG. 4 is a view similar to FIG. 3, but illustrating the switch in its open condition;

FIG. 5 is a detail front elevational view, partially in section, illustrating the method of mounting the switch to the enclosure;

FIG. 6 is an end elevational of the apparatus, the apparatus being illustrated in combination with a typical hospital bed to show the manner in which the lighting fixture is upwardly tilted upon engagement by equipment mounted on the bed; and FIG. 7 is a diagrammatic view of the electrical circuitry of the present bed light safety apparatus.

DESCRIPTION OF THE PREFERRED EMBODIMENT

Referring now to the drawings, there is illustrated a bed light safety apparatus, designated generally by the numeral 10 and comprising an elongated rectangular, transversely oriented mounting plate 12 adapted for attachment to a wall 14 behind a hospital bed 16. The flat rear face of the plate 12 fits against the wall 14 over a conventional junction box, indicated in dotted outline, and is secured to the wall by suitable fasteners (not shown) passing through openings 18 in the plate 12 and into the wall 14.

The lower and side margins of the plate 12 are provided with peripheral flanges. The upper edge is welded, as best shown in FIGS. 3 and 4, to one leaf of a transversely elongated piano hinge 20.

The other leaf of the hinge 20 is secured along its length by a plurality of fastener assemblies 22 to the upper rearward portion of an elongated, transversely oriented lighting fixture 24 which houses other parts of the apparatus 10. The fixture 24 is rectangular in transverse cross-section and is characterized by a pair of rectangular ends 26, a rear wall 28, and a front wall 30. The fixture 24 also includes upper and lower walls 32 and 34, respectively, made of acrylic lens material or the like for transmitting light from the light (not shown) located within the enclosure 24. The lighting fixture 24 is electrically connected through plate 12 to a junction box 36 in the wall 14 by means of a flexible electrical cord 38 which plugs into a suitable fitting 40.

As best seen in FIG. 6, the apparatus 10 is conveniently located above the bed 16 in position to illuminate the patient or convalescent. The usual bed 16 mounts equipment such as an intravenous support bracket 42. Traction equipment (not shown) is also often mounted to such a bed.

The bed 16 is provided with an electrically energizable drive means, diagrammatically indicated at 44 in FIG. 7, which is operative to raise and lower the bed, as is well known in the prior art. Details of the drive means 44 are not important to the present invention and are omitted for brevity.

As indicated in phantom outline in FIG. 6, raising of the bed by the drive means 44 frequently accidentally results in the traction apparatus or intravenous support bracket 42 striking the fixture 24. In the present apparatus 10 the hinge 20 allows the fixture 24 to pivot upwardly about a horizontal axis when it is struck by the bracket 42, for example. In contrast, the immovable bed lights or lighting fixtures of the prior art would have been damaged by such an impact, or they would have damaged equipment on the bed, long before the person raising the bed was aware of what was happening.

Upward pivotal movement of the fixture 24, is, in one embodiment, operative to immediately de-energize the drive means 44 to halt any further raising of the head portion of the bed 16. As best seen in FIG. 7, a switch means in the form of a micro-sensitive switch 46 is arranged in series with a drive means 44 and a source of electrical energy 48. A common form of drive means 44 is reversible and is in circuit with a pair of push button switches 50 and 52, one of the switches being actuable to operate drive means 44 in one direction to raise the bed, while the other of the switches is actuable to operate the means 44 in the opposite direction to lower the bed.

The switch 46 may simply be a single throw switch to open and close the circuit to the drive means 44. However, if desired, it can be a double throw type, as illustrated, to actuate alarms. Thus, when the switch arm is moved to open the circuit to the drive means 44, it then closes a circuit 54 which includes a visual alarm or light 56 and an auditory alarm or buzzer 58. Operation of these alarms provides further indication that the bed must be immediately lowered to avoid injury to the patient, or damage to the lighting fixture 24 or the equipment mounted to the bed. The switch 46 could also be arranged, as will be apparent, to effect operation of any one or combination of the light 56, the buzzer 58, and the drive means 44, as desired.

As best seen in FIGS. 3, 4 and 5, the micro-sensitive switch 46 includes a cylindrical threaded portion extending through a suitable opening in the rear wall 28. A pair of nuts 60 are threaded onto the threaded portion and bear against the opposite faces of the rear wall 28 to maintain the switch 46 in the position illustrated. A switch element or plunger 62 is slidably carried in the threaded cylindrical portion of the switch, and is biased outwardly in position for engagement with the inner face of the mounting plate 12. As seen in FIG. 3, such engagement occurs in the downwardly pivoted or normal position of the fixture 24, and is effective to close the circuit to the drive means 44, as illustrated in FIG. 7. Operation of the appropriate push button switch 50 or 52 is now effective to raise the bed 16. However, as soon as the fixture 24 is pivoted upwardly slightly by virtue of impingement between the fixture and equipment such as the support bracket 42, the switch plunger 62 is biased outwardly, as seen in FIG. 4, and the circuit to the drive means 44 is opened. The drive means 44 becomes inoperative and further upward movement of the bed ceases.

Any pivoting of the fixture 24, resulting from impingement by the bracket 42 or the like, immediately apprises the person operating the drive means 44 that the fixture 24 has been struck. Further, the ability to safely pivot the fixture 24 greatly simplifies access to certain portions of the apparatus 10, as will be apparent.

Various modifications and changes may be made with regard to the foregoing detailed description without departing from the spirit of the invention.

I claim:

1. In a combination comprising an electric lighting fixture to be mounted to a wall, so as to overhang an electrically elevatable bed, and a switch to be connected in electrical circuits for the fixture and the bed and arranged to enable electric power to elevate the bed under normal conditions but to disable such power upon physical interference between the bed, or an object carried by the bed, and the fixture, an improvement wherein the fixture is to be mounted to the wall be a means permitting the fixture as a whole to be displaced from an attitude close to the wall when any part of the fixture is urged upwardly at a point away from the wall, and wherein the switch is arranged for movement between a closed position to enable electric power to elevate the bed when the fixture assumes such attitude and an open position to disable such power when the fixture has been displaced from such attitude, said switch being provided with an operating member yieldably biasing the latter toward said closed position, said member being disposed for holding said switch in said closed position against said biasing only when said fixture assumes such attitude.

2. The improvement of claim 1 wherein the means to mount the fixture to the wall is a hinge permitting the fixture as a whole to be pivoted upwardly about a horizontally disposed axis when urged as mentioned.

3. The improvement of claim 2 wherein the hinge has a leaf to be mounted to the wall whereby the axis is close to the wall.

* * * * *